US005497046A

United States Patent [19]

Van Gorkom et al.

[11] Patent Number: 5,497,046

[45] Date of Patent: Mar. 5, 1996

[54] THIN-TYPE PICTURE DISPLAY DEVICE

[75] Inventors: Gerardus G. P. Van Gorkom; Petrus H. F. Trompenaars; Siebe T. De Zwart; Nicolaas Lambert, all of Eindhoven, Netherlands

[73] Assignee: U.S. Philips Corporation, New York, N.Y.

[21] Appl. No.: 415,220

[22] Filed: Mar. 28, 1995

Related U.S. Application Data

[63] Continuation of Ser. No. 335,218, Nov. 7, 1994, abandoned, which is a continuation of Ser. No. 223,962, Jul. 17, 1992, abandoned, which is a continuation of Ser. No. 715,072, Jun. 13, 1991, abandoned.

[30] Foreign Application Priority Data

Jul. 5, 1990 [NL] Netherlands ..... 9001528

[51] Int. Cl.[6] ..... H01J 29/20; H01J 29/72

[52] U.S. Cl. ..... 313/422; 313/495

[58] Field of Search ..... 313/422, 495, 313/496; 315/169.4; 345/37, 41, 47, 50

[56] References Cited

U.S. PATENT DOCUMENTS 4,069,439 1/1978 Anderson ..... 313/422
4,757,230 7/1988 Washington et al. ..... 313/422
4,879,496 11/1989 Knapp et al. ..... 313/422 X
4,927,218 5/1990 Zegers ..... 313/422 X

FOREIGN PATENT DOCUMENTS 0079108 5/1983 European Pat. Off. ..... H01J 31/12

*Primary Examiner*—Sandra L. O'Shea
*Assistant Examiner*—Ashok Patel
*Attorney, Agent, or Firm*—Robert J. Kraus

[57] ABSTRACT

A picture display device having a vacuum envelope whose inner wall is provided with a luminescent screen. The device is a plurality has a of juxtaposed sources for producing electrons, local transport ducts having walls of electrically substantially insulating material having a secondary emission coefficient which is suitable for transporting, through a vacuum, electron beams, preselection means for withdrawing electrons from the transport ducts at predetermined extraction locations and for directing them towards the luminescent screen for producing a picture composed of pixels. A structure of distribution ducts having selection apertures is positioned between the transport ducts and the luminescent screen for fine selection of electrons withdrawn from the transport ducts.

20 Claims, 4 Drawing Sheets

FIG. 1
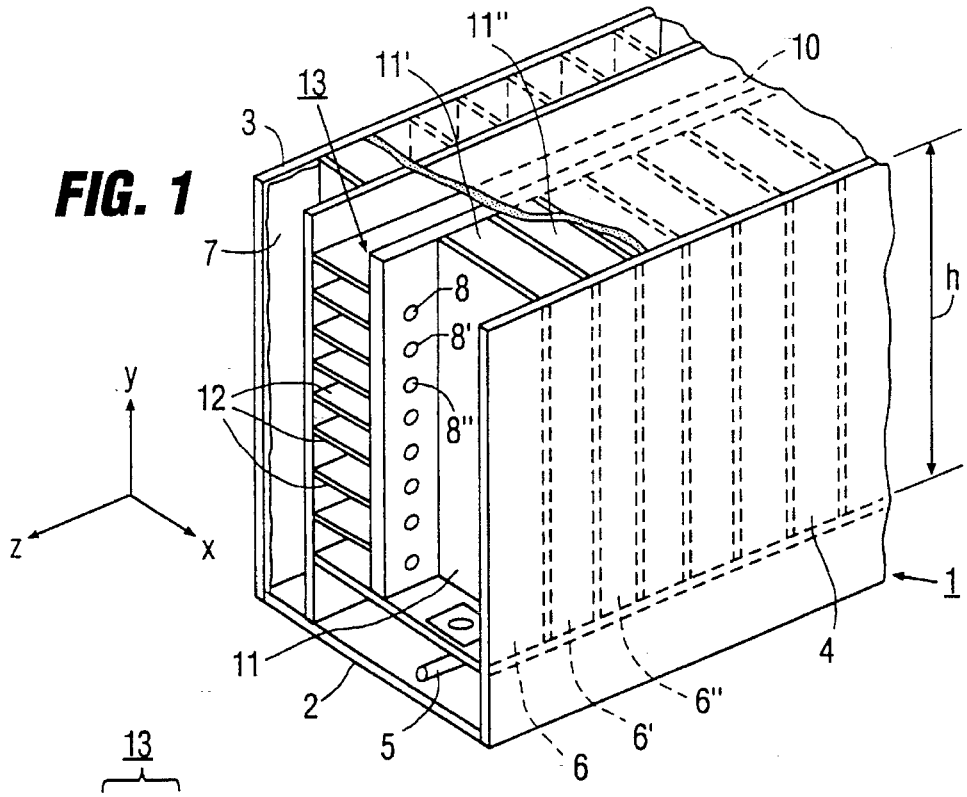
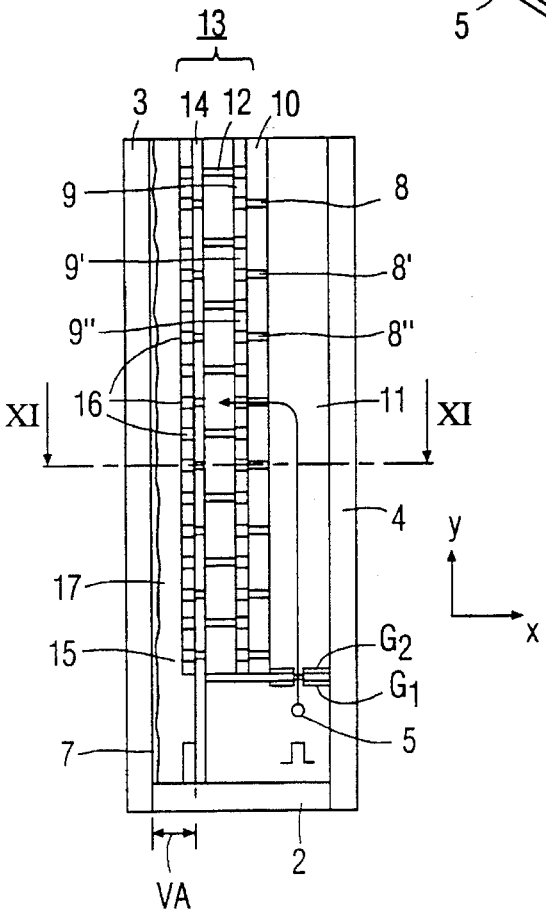
FIG. 2
FIG. 4
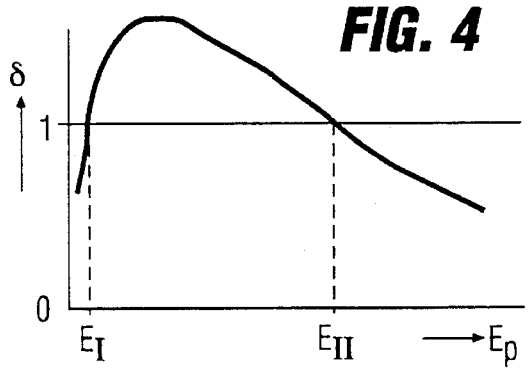

FIG. 3
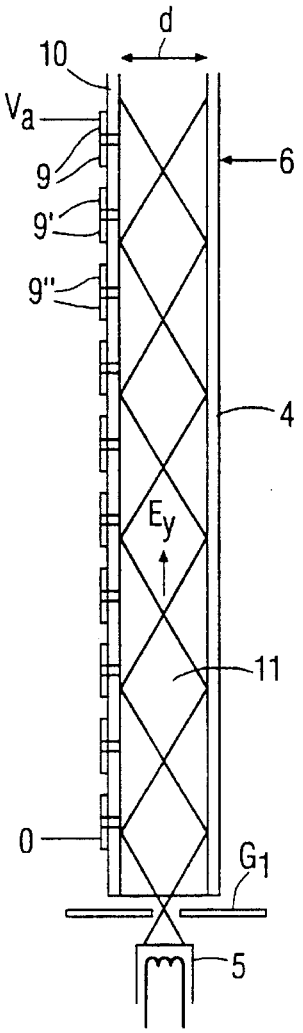
FIG. 6
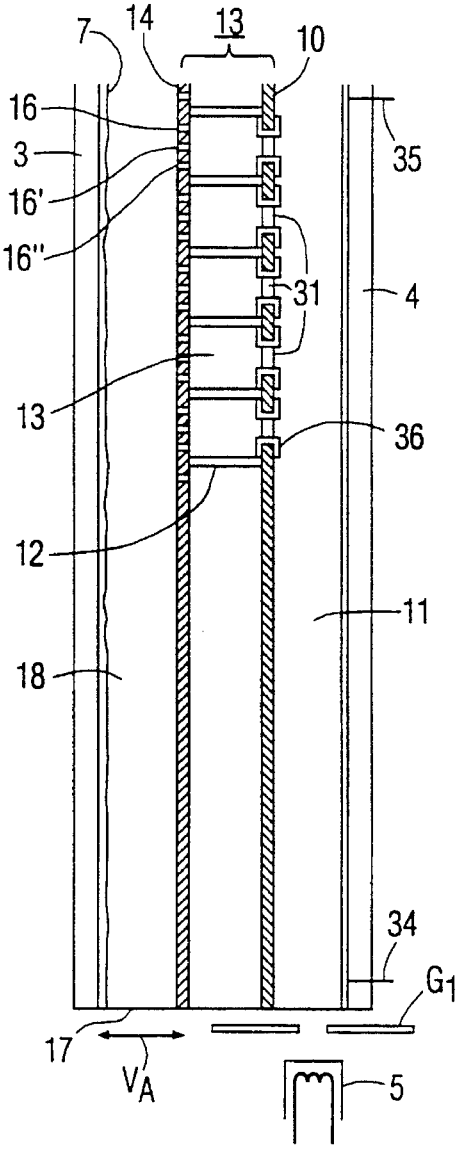
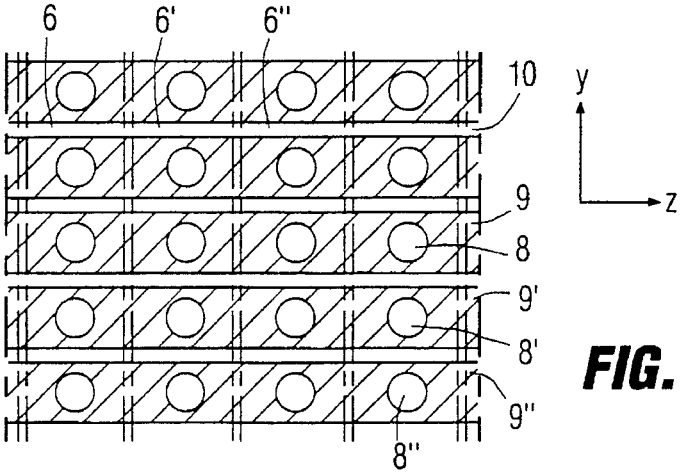
FIG. 5

FIG. 10
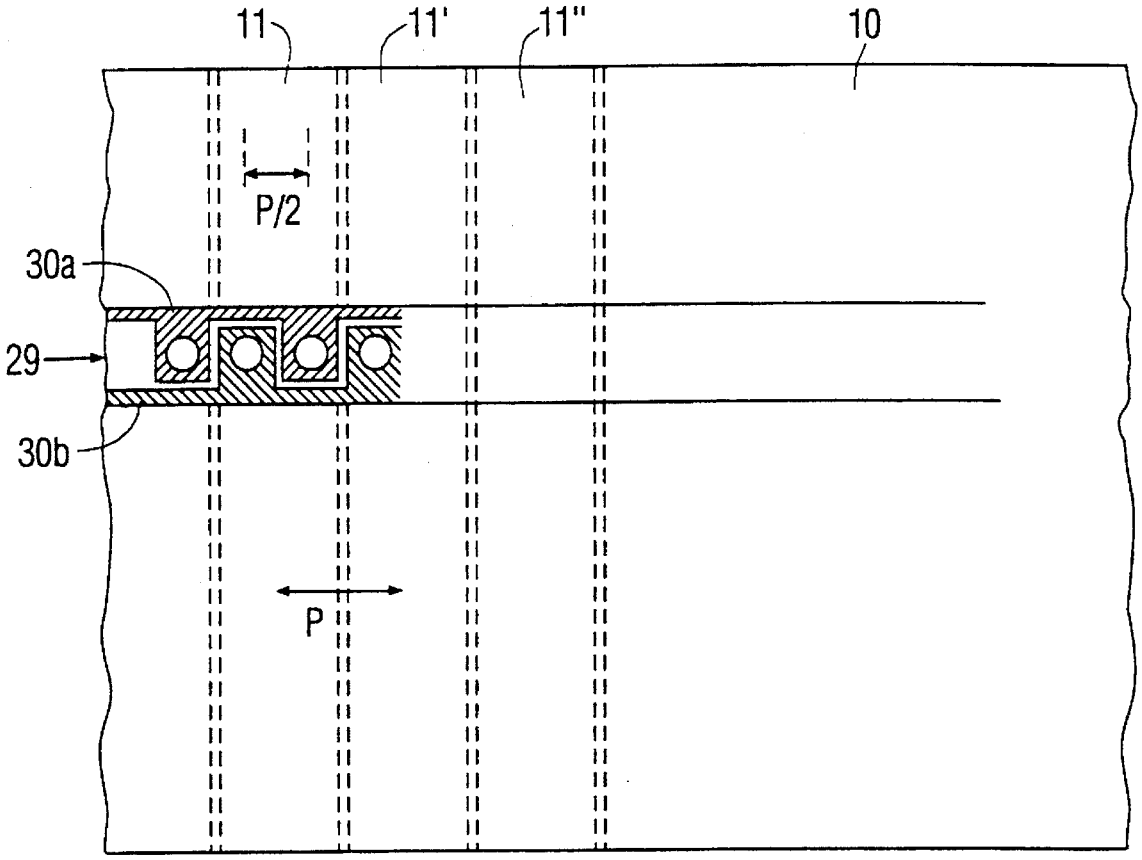
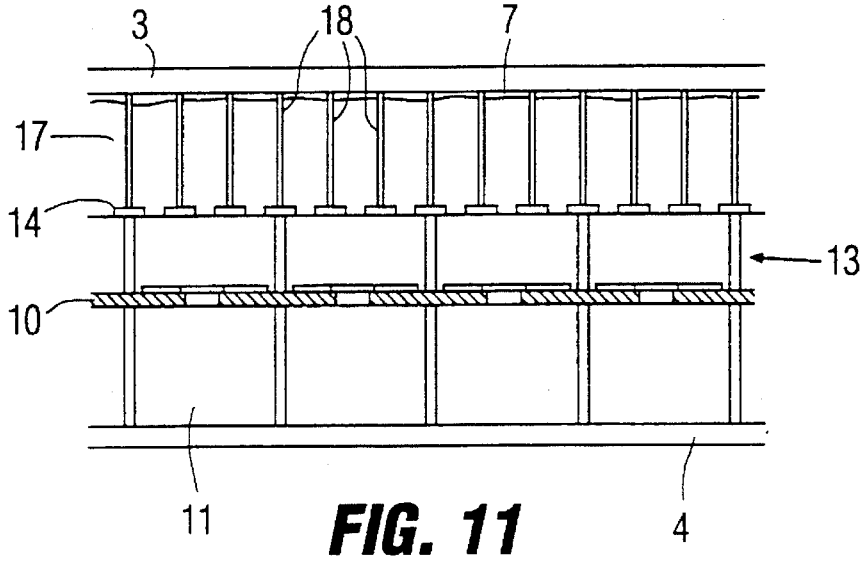
FIG. 11

THIN-TYPE PICTURE DISPLAY DEVICE

This is a continuation of a prior application Ser. No. 08/335,218, filed on 7 Nov. 1994, now abandoned, which is a continuation of Ser. No. 08/223,962, filed on 17 Jul. 1992, now abandoned, which is a continuation of Ser. No. 07/715,072, filed on 13 Jun. 1991 now abandoned.

BACKGROUND OF THE INVENTION

The invention relates to a picture display device having a vacuum envelope for displaying pictures composed of pixels on a luminescent screen, and particularly relates to a thin picture display device (i.e. a picture display device having a small "front-to-back dimension") which is clearly distinguished from state-of-the-art display devices.

Typical state-of-the-art approximations to thin-type picture display devices are devices having a transparent face plate and a rear plate which are interconnected by means of partitions and in which the inner side of the face plate is provided with a phosphor pattern, one side of which is provided with an electrically conducting coating (the combination also being referred to as luminescent screen). If (video information-controlled) electrons impinge upon the luminescent screen, a visual image is formed which is visible via the front side of the face plate. The face plate may be flat or, if desired, curved (for example, spherical or cylindrical).

A specific category of picture display devices of the thin type uses single or multiple electron beams which initially extend substantially parallel to the plane of the display screen and are ultimately bent towards the display screen so as to address the desired areas of the luminescent screen either directly or by means of, for example, a selection grid structure. (The expression electron beam is understood to mean that the paths of the electrons in the beam are substantially parallel, or extend only at a small angle to one another and that there is a main direction in which the electrons move). The above-mentioned devices operating with controlled electron beams require, inter alia, complicated electron-optical constructions.

Moreover, picture display devices of the single beam type generally require a complicated (channel plate) electron multiplier of the matrix type, certainly if they have slightly larger screen formats.

SUMMARY OF THE INVENTION

In view of the foregoing it is an object of the invention to provide a thin-type picture display device which substantially does not have the drawbacks of the above-mentioned devices.

According to the invention, a picture display device having a vacuum envelope for displaying pictures composed of pixels on a luminescent screen therefore comprises a plurality of juxtaposed sources for producing electrons, local transport ducts cooperating with the sources and having walls of electrically substantially insulating material having a secondary emission coefficient suitable for transporting produced electrons in the form of electron currents, and first selectively energizable electrode means for withdrawing each electron current from its transport duct at predetermined extraction locations which are directed towards the luminescent screen, each extraction location communicating with a structure of distribution ducts located between the transport ducts and the luminescent screen, which structure has at least two selection apertures for each extraction location in a wall facing the luminescent screen, while second selectively energizable electrode means are associated with the selection apertures so as to withdraw electrons from the structure of distribution ducts via selected apertures, and further means are provided to direct electrons withdrawn from selected apertures to the luminescent screen for producing a picture composed of pixels.

The inventive approach of providing a thin-type picture display device is based on the discovery that electron transport is possible when electrons impinge on an inner wall of an elongate evacuated cavity (so-called compartment) defined by walls of electrically substantially insulating material (for example, glass or synthetic material) if an electric field of sufficient power is realised in the longitudinal direction of the compartment (for example, by applying an electric potential difference across the ends of the compartment). The impinging electrons then generate secondary electrons by wall interaction which are attracted to a further wall section and in their turn generate secondary electrons by wall interaction. As will be further described, the circumstances (field strength E, electrical resistance of the walls, secondary emission coefficient $\delta$ of the walls) may be chosen to be such that a constant vacuum current will flow in the compartment.

Starting from the above-mentioned principle, a flat picture display device can be realised by providing each one of a plurality of juxtaposed compartments constituting transport ducts with a column of apertures constituting extraction locations at one side to be directed towards a display screen. In this case it is practical to arrange the extraction locations of adjacent transport ducts along parallel lines extending transversely to the transport ducts. By associating row-sequentially arranged electrode means to the arrangement of apertures, which means are energizable by means of a first (positive) electric voltage (pulse) so as to withdraw electron currents from the compartments via the apertures of a row, or which are energizable by means of a second (lower) electric voltage if no electrons are to be locally withdrawn from the compartments, an addressing means is provided with which electrons withdrawn from the compartments can be directed towards the screen for producing a picture composed of pixels.

To ensure that the number of apertures per transport column is not too large, the invention provides for a structure of distribution ducts arranged between the transport ducts (the compartments) and the display screen, which structure has at least two selection apertures per extraction location. The extraction locations in the transport ducts then enable a preselection and the selection apertures in the distribution duct enable a fine selection.

The structure of distribution ducts may comprise a spacer with spacer walls. Distribution ducts are then defined between these spacer walls. The "width" of these distribution ducts can be chosen to be such that exactly one picture line is selected and that there is fine selection to three colour lines. Distribution ducts having a larger "width" are, however, also possible, for example distribution ducts having such a "width" that two (three) picture lines are selected and that there is fine selection to six (nine) colour lines.

An embodiment enabling the number of drive circuits required to energize the second electrode means to be reduced is characterized in that the second selectively energizable electrode means comprise an arrangement of line-sequentially arranged sub-electrodes and in that sub-electrodes associated with corresponding selection apertures of the structure of distribution ducts are electrically (particularly capacitively) connected in a parallel arrangement.

A constructive embodiment is characterized in that within the vacuum envelope the wall of the structure of distribution ducts facing the luminescent screen is spaced apart from the transparent face plate by means of a spacer. An effective vacuum support can be realised by building up the inner structure of the inventive picture display device from back to front from (vertical) transport ducts, a structure of distribution ducts and a spacer. The spacer may comprise, for example, a system of mutually parallel walls extending transversely to the transparent face plate, or it may comprise a plate provided with a plurality of apertures which are in alignment with the extraction apertures of the distribution ducts.

An embodiment which is suitable for colour display is characterized in that the number of parallel lines along which the extraction locations of adjacent transport ducts are arranged corresponds to the number of lines of a picture to be displayed, in that the number of selection apertures per extraction location corresponds to the number of different phosphors on the luminescent screen and in that the selection apertures per extraction location are arranged in accordance with the phosphor arrangement on the luminescent screen. The possibility which is thereby provided to arrange the (fine) selection apertures in accordance with the phosphor arrangement on the luminescent screen is very interesting, as will be described hereinafter. For example, the selection apertures per extraction location can be arranged in a delta configuration in combination with a hexagonal phosphor pattern.

An embodiment enabling the number of transport ducts to be reduced is characterized in that each extraction location defines at least a first and a second aperture and in that the first selectively energizable electrode means comprise at least a first system of sub-electrodes for line-sequentially driving the first apertures and a second system of sub-electrodes for line-sequentially driving the second apertures.

It has been assumed in the foregoing that a (video) line is selected by applying a positive voltage pulse to the relevant line selection electrode. Each picture line will have to be driven by separately formed electrodes.

If in accordance with a further embodiment of the invention the structure of distribution ducts comprises at least two successive layers, it is possible to reduce the number of line selection electrodes drastically. In fact, the line selection can then be carried out in two or more steps (dependent on the number of sub-distribution ducts).

BRIEF DESCRIPTION OF THE DRAWING

Some embodiments of the invention will be described in greater detail with reference to the drawings in which the same reference numerals are used for corresponding components.

FIG. 1 is a diagrammatic perspective elevational view, partly broken away, of a part of a construction of a picture display device according to the invention whose components are not drawn to scale;

FIG. 2 is a side elevation, broken away, of the construction of FIG. 1 to illustrate the general operation of the invention;

FIG. 3 shows the operation of a specific electron transport duct to be used in the construction of FIG. 1 with reference to a "vertical" cross-section;

FIG. 4 shows a graph in which the secondary emission coefficient $\delta$ as a function of the primary electron energy $E_p$ is plotted for a wall material which is characteristic of the invention;

FIG. 5 shows a characteristic (selection) electrode arrangement to be used in the construction of FIG. 1;

FIG. 6 is a side elevation, broken away, of a first alternative to the construction shown in FIG. 2;

FIG. 10 shows diagrammatically a modification of the (selection) electrode arrangement of FIG. 5; and FIG. 11 is a diagrammatic cross-section taken on the line XI—XI through the construction of FIG. 2.

DESCRIPTION OF THE PREFERRED EMBODIMENTS

Figure 7:
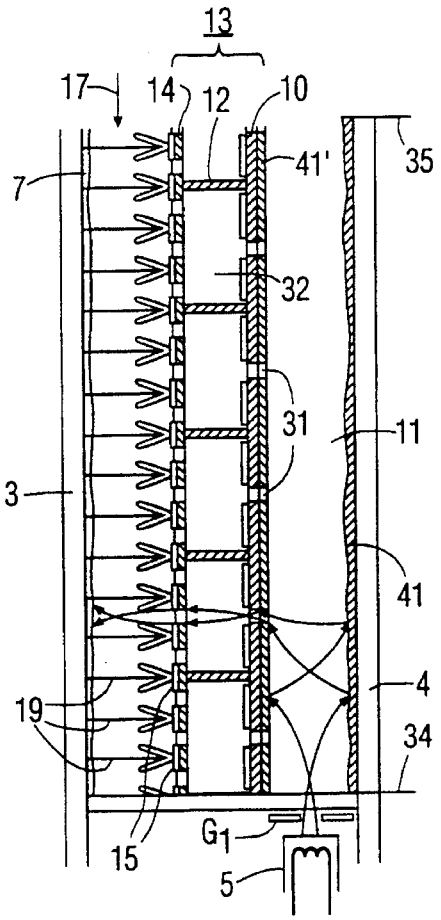
FIG. 7 is a side elevation, broken away, of a second alternative to the construction shown in FIG. 2.

FIG. 1 shows a thin-type picture display device 1 according to the invention having a front wall (window) 3 and a rear wall 4 located opposite said front wall. An electron source arrangement 5, for example, a line cathode which by means of electrodes provides a large number of electron emitters, for example 600, or a similar number of separate emitters is arranged proximate to a wall 2 which connects panel 3 and the rear wall. Each of these emitters is to provide a relatively small current so that many types of cathodes (cold or thermal cathodes) are suitable as emitters. The emission is preferably controlled by means of the video signal. An alternative is to apply the video information to a gating structure arranged subsequent to the electron sources, instead of to the emitters. The electron source arrangement 5 is arranged opposite to entrance apertures of a row of transport ducts extending substantially parallel to the screen, which ducts are constituted by compartments 6, 6', 6", . . . etc. in this case one compartment for each electron source. These compartments, one of which is shown in a cross-section in FIG. 3, have cavities 11, 11', 11", . . . defined by walls. At least one wall (preferably the rear wall) of each compartment is made of a material which has a suitable electrical resistance for the purpose of the invention (for example, ceramic material, glass, synthetic material—coated or uncoated) and which has a secondary emission coefficient $\delta>1$ over a given range of primary electron energies (see FIG. 4). The electrical resistance of the wall material has such a value that a minimum possible total amount of current (preferably less than, for example 10 mA) will flow in the walls in the case of a field strength ($E_y$) in the compartments of the order of one hundred to several hundred Volts per cm, required for the electron transport. By applying a voltage on the order of several dozen to several hundred Volts (value of the voltage is dependent on circumstances) between electron source 5 and the compartment, electrons are accelerated from the electron source 5 towards the compartment 6 whereafter they impinge upon the wall in the compartment and generate secondary electrons.

The invention is based on the recognition that vacuum electron transport within compartments having walls of electrically insulating material is possible if an electric field ($E_y$) of sufficient power is applied in the longitudinal direction of the compartment. Such a field realises a given energy distribution and spatial distribution of electrons injected into the compartment so that the effective secondary emission coefficient $\delta_{eff}$ of the walls of the compartment will be equal to 1 on average in operation. Under these circumstances one electron will leave for each electron which enters (on average), in other words, the electron current is constant throughout the compartment and is approximately equal to the current which enters. If the wall material is high-ohmic enough (which is the case for all appropriate untreated glass types, as well as for kapton, pertinax and ceramic materials), the walls of the compartment cannot produce or take up any net current so that this current, even in a close approximation is equal to the entering current. If the electric field is made larger than the minimum value which is required to obtain $\delta_{eff}=1$, the following will happen. As soon as $\delta_{eff}$ is slightly larger than 1, the wall is charged inhomogeneously positively (due to the very small conductance this charge cannot be depleted). As a result, the electrons will reach the wall earlier on average than in the absence of this positive charge, in other words, the average energy taken up from the electric field in the longitudinal direction will be smaller so that a state with $\delta_{eff}=1$ adjusts itself. This is a favourable aspect because the exact value of the field is not important, provided that it is larger than the previously mentioned minimum value.

Another advantage is that in the state $\delta_{eff}=1$ the electron current in the compartment is constant and can be made to be very satisfactorily equal via measuring and feed-back or via current control for each compartment so that a uniform picture can be realised on the luminescent screen.

The compartment walls facing the luminescent screen 7, which is arranged on the inner wall of the panel 3, are constituted by a preselection plate 10 (see FIG. 2). This plate 10 has extraction apertures 8, 8', 8", . . . etc which define extraction locations. Provided that specific provisions have been made, a "gating" structure can be used to "withdraw" a flow of electrons from a desired aperture when using cathodes which are not separately driven. However, cathodes which are individually driven by means of drive electrodes G1 and G2 are preferably used in combination with apertured strip-shaped selection electrodes 9, 9', 9", . . . (see also FIG. 5) to be energized by a selection voltage. These electrodes are present on the surface of the plate 10 facing the front wall 3 in FIG. 2. Alternatively, they may be provided on the surface of plate 10 facing the rear wall 4, or on both surfaces. In the latter case the facing selection electrodes are preferably interconnected electrically via the apertures 8, 8', 8". These selection electrodes 9, 9', 9" . . . are implemented for each picture line, for example in the way shown in FIG. 5 ("horizontal" electrodes with apertures coaxial with the apertures 8, 8', 8", . . . ). The apertures in the electrodes will generally be at least as large as the apertures 8, 8', 8", . . . . If they are larger, aligning will be easier. Desired locations on the screen 7 can be addressed by means of (matrix) drive of the individual cathodes and the selection electrodes 9, 9', 9", . . . . For example, voltages which increase substantially linearly (as viewed from the cathode side) are applied to the selection electrodes 9, 9', 9", . . . . When a picture line must be activated, i.e. when electrons must be withdrawn via apertures in an aperture row from the column-wise arranged electron currents flowing behind them, a pulsatory voltage $\Delta U$ is added to the local voltage. In view of the fact that the electrons in the compartments have a relatively low velocity due to the collisions with the walls, $\Delta U$ may be comparatively low (of the order of, for example 100 V to 200 V). In this case a voltage difference $V_a$ is taken across the total compartment height, which is just too small to draw electrons from apertures. This does happen by applying a positive line selection pulse of the correct value.

In the embodiment as shown in FIG. 2 each picture line is driven by an electrode 9, 9', 9", . . . on the (pre)selection plate 10. Thus, electrons are withdrawn from a transport duct 11 into the structure 13 of distribution ducts via a driven aperture 8, 8', 8". FIG. 2 shows a structure 13 of distribution ducts with "horizontal" partitions 12. The structure 13 of distribution ducts has a wall 14 facing the selection plate 10 and being provided with apertures at least two of which are associated, according the invention, with an aperture 8, 8', 8" . . . in the (pre)selection plate 10 defining an extraction location. By providing these apertures with energizing electrodes 15 analogously as the apertures in the plate 10, colour selection can be realised by means of the structure 13 of distribution ducts, for example, in the case of three apertures 16, 16', 16" (FIG. 6) associated with each extraction location. The possibility of electrically interconnecting colour selection electrodes per colour (for example, via coupling capacitors) is important. In fact, a preselection has taken place already and electrons can no longer reach the wrong line. This means that a total number of only three separately implemented colour selection electrodes is required for this form of colour selection. In the construction shown in FIG. 6 the colour selection apertures 16, 16', 16" are located on a "vertical" line for each extraction location and correspond to "horizontal" phosphor lines on the luminescent screen 7, while "vertical" spacer walls are arranged between the front panel 3 and selection plate 14 and a spacer with "horizontal" walls 12 is arranged between each pair of apertures, associated with each extraction location, in the structure of distribution ducts. An alternative is a spacer with "vertical" walls. In that case it is recommendable to interconnect every second colour selection electrode of the same colour. This means that all electrodes having an even ordinal number are interconnected to each other and that all electrodes having an odd ordinal number are interconnected to each other. By applying an accelerating voltage $V_A$ of several kilovolts, electrons withdrawn from the (colour) selection apertures are accelerated in the acceleration space 17 towards the luminescent screen 7.

In the construction shown in FIG. 2 the colour selection apertures in the wall 14 are located on a "horizontal" line for each extraction location and correspond to "vertical" phosphor lines on the luminescent screen 7. Since the spacer walls 12 extend parallel to the row of colour selection apertures, it is recommendable to interconnect every second colour selection electrode of the same colour, in the manner as described hereinbefore with reference to FIG. 6. Here again the electrons withdrawn from the (colour) selection apertures are accelerated in acceleration space 17 towards the luminescent screen 7.

For a satisfactory vacuum support a spacer is not only preferably arranged in the structure 13 of distribution ducts but also in the acceleration space 17. Such a spacer may comprise "horizontal" spacer walls 19 extending transversely to the front wall 3, as is shown in FIG. 7, or "vertical" spacer walls 18 extending transversely to the front wall 3, as is shown in FIG. 6 and in FIG. 11 which is cross-section taken on the line XI—XI in FIG. 2. An alternative construction with spacer walls is a spacer plate having apertures which are in alignment with the (colour) selection apertures in the wall 14 or with the extraction apertures in the wall 10.

Figure 8:
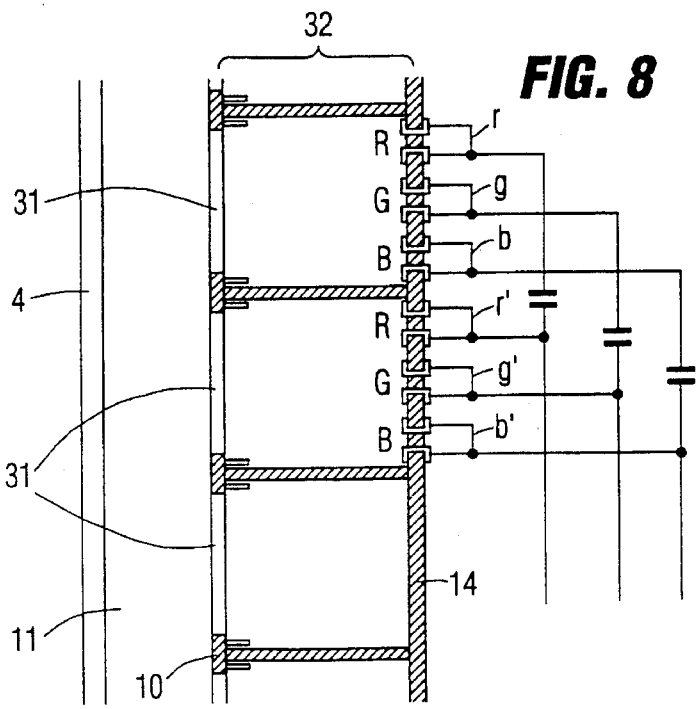
FIG. 8 shows diagrammatically a part of a construction which is comparable with the construction of FIG. 7, in combination with an electric circuit diagram.

FIG. 8 shows diagrammatically an embodiment of a a single-column structure 32 of distribution ducts and an electric parallel circuit of fine selection electrodes r, g, b; r', g', b', etc. associated with corresponding apertures of the fine selection apertures R, G, B. If each transport duct 11 has $_m^D$ extraction locations 31 per column, and each distribution duct 32 has m (fine) selection apertures per extraction location, $_m^D \neq$ m electric connections for energizing the total number of electrodes are required to display n picture lines on the screen in the case of monochrome display. Thus, for example, if n=600, only 203 instead of 600 electric connections are required when using a construction of the FIG. 8 type in which m=3. If m=6, which is still quite realisable, only 106 connections are required. In the case of colour display a number of $_m^D$ extraction apertures and 3 m (fine) selection apertures per extraction location are required to write n picture lines on the screen. For example, 609 connections are then required (if m=1), or 306 (if m=2) instead of 1800 for energizing the total number of electrodes.

In a multi-layer structure of distribution ducts the fine selection can be carried out in more than one step so that the number of connections can be still further reduced. In the preferred embodiment of a double layer structure of distribution ducts, 1024 lines can be driven, for example, by performing the fine selection in 2 steps by means of 2×32 electrodes. Consequently, only 64 connections are required in this case.

Figure 9:
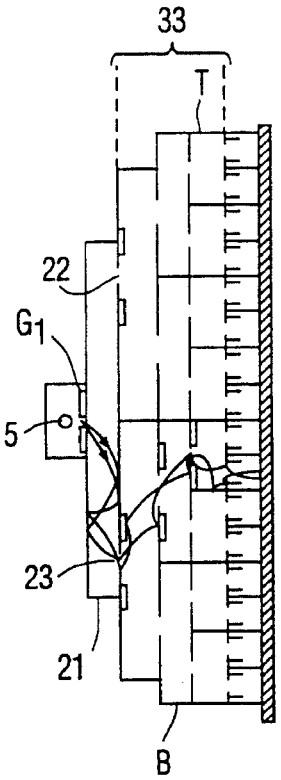
FIG. 9 shows diagrammatically a "multi-layer" modification of the construction shown in FIG. 2.

FIG. 9 shows diagrammatically an example of a cross-section through a construction having a three layer structure 33 of distribution ducts.

In this example an electron source arrangement 5 is arranged halfway between the top T and the bottom B of the construction. Electrons emitted by the sources enter a number of parallel transport ducts 21 of the type described with reference to FIG. 3. In this example each transport duct has two extraction locations 22 and 23. Two selection apertures, etc. are associated with each extraction location 22, 23. This "digital" modification may drive $2^n$ lines in n steps, i.e. 16 lines in 3 steps and, for example, 1024 lines in 10 steps. In the latter case a total number of only 20 selection electrodes is required. A number of 20 selection electrodes is, however, minimal, but in this extreme case the construction should be built up from 10 columns, which makes it complicated and leads to a relatively thick display device. However, it will be clear that the number of layers, the number of extraction locations and the number of selection apertures per extraction location can be varied optionally.

In the embodiments shown the horizontal picture resolution is determined by the pitch of the transport ducts. A better resolution can thus be obtained by making this pitch smaller. However, this has the drawback that the voltage drop across the ducts required for transporting the electron currents will increase, which is not always desirable. This problem can be solved by giving only the structure of distribution ducts the required smaller pitch, combined with an adapted pattern of the preselection apertures and electrodes. FIG. 10 shows diagrammatically a part of a preselection plate 10 with transport ducts 11, 11', 11", . . . in which there are two extraction apertures for each extraction location so that the pitch of the distribution ducts is half (p/2) that of the transport ducts (p). Each preselection electrode 29 is divided into two apertured sub-electrodes 30*a* and 30*b* in the manner shown, which simplifies contacting. In this way the horizontal resolution can be doubled with respect to the construction shown in FIG. 5, while the transport ducts 11, 11', 11" . . . can be controlled by the same voltages and in the same manner.

It is to be noted that the selection electrodes are preferably implemented as apertured strips of electrically satisfactorily conducting material, like the electrodes 9, 9', 9", . . . . in FIG. 5. Under specific circumstances, particularly in the case of a large distance to be bridged in the acceleration space 17 to the luminescent screen 7 it is, however, advantageous to implement them as cylindrical or conical bushes possibly provided with flanges or as pierced strips which are provided with such bushes (FIG. 7).

To operate the display device according to the invention in an advantageous mode, a well-defined electric voltage increasing from the cathode side is to be applied particularly across the front and rear walls of the transport ducts, the voltage on the front wall always being slightly lower at the same height. This can be realised, for example, by adjusting the wall potential by means of a high-ohmic resistance layer 41, 41' provided on the relevant wall and having electric contacts 34, 35 at its lower and upper sides (FIG. 7). This resistance layer may have a meandering or zigzag pattern for increasing the resistance. The front wall potential may be adjusted by arranging strip-shaped electrodes 36 on the inner side of the transport ducts and giving them, in operation, a (substantially linearly) increasing potential. These electrodes may also be used advantageously for (picture) line selection by providing them with apertures aligned with the apertures in the preselection plate and connecting them to a circuit for providing a (positive) selection voltage (FIG. 6).

It is to be noted that the expressions "horizontal" and "vertical" have been used in the foregoing to indicate directions which are transverse to each other. This means that the transport ducts may extend alternatively in the "horizontal" direction, in combination with column-wise ("vertically") arranged extraction locations. Picture memories may then be used for displaying pictures on the screen.

We claim:

1. A display device comprising an evacuable envelope and including a face plate bearing a luminescent screen and means for selectively directing electrons toward the screen for producing an image composed of pixels, said means comprising:

a. at least one electron source;

b. a plurality of adjacent, longitudinally extending transport ducts having respective walls comprising an electrically insulating material having a predetermined secondary emission coefficient, said ducts each having an input portion in communication with the at least one electron source for receiving electrons and having a plurality of apertured extraction locations for enabling the extraction of electrons from the duct;

c. an arrangement of distribution ducts located between the transport ducts and the luminescent screen, said arrangement including a wall facing the luminescent screen and having at least two selection apertures in communication with each of the extraction locations;

d. extraction electrode means disposed adjacent the extraction locations for selectively effecting extraction of electrons from the transport ducts at selected ones of said locations;

e. selection electrode means disposed adjacent the selection apertures for selectively effecting transport of electrons from the distribution ducts through selected ones of the selection apertures; and f. means for directing toward the screen the electrons which are transported through the selection apertures.

2. A display device as in claim 1 where the extraction locations of adjacent ones of the transport ducts are arranged along parallel lines extending transversely to said transport ducts.

3. A display device as in claim 1 where the selection electrode means comprise an arrangement of line-sequentially-arranged sub-electrodes.

4. A display device as in claim 1 where the wall facing the luminescent screen is separated from the face plate by spacer means.

5. A display device as in claim 4 where the spacer means comprises a system of mutually parallel walls extending transversely to the face plate.

6. A display device as in claim 4 where the spacer means comprises a plate having a plurality of apertures which are in alignment with respective ones of the selection apertures.

7. A display device as in claim 2 where:

a. the number of parallel lines corresponds to the number of lines of an image to be displayed;

b. the number of selection apertures in communication with each of the extraction locations corresponds to the number of different colors to be displayed on the luminescent screen; and c. the luminescent screen comprises respective phosphor materials for producing said colors which are arranged in correspondence with said selection apertures.

8. A display device as in claim 2 where each extraction location includes first and second extraction apertures and where the extraction electrode means comprises a first system of sub-electrodes for selectively driving respective lines of the first extraction apertures and a second system of sub-electrodes for selectively driving respective lines of the second apertures.

9. A display device as in claim 1 where the arrangement of distribution ducts comprises a plurality of successive layers of distribution duct structure disposed between the transport ducts and the luminescent screen.

10. A display device comprising an evacuable envelope and including a face plate bearing a luminescent screen having a multiplicity of predefined areas and means for selectively energizing respective ones of said areas to produce an image, said means comprising:

a. at least one electron source;

b. a plurality of adjacent, longitudinally extending transport ducts, each having at least one wall means comprising a material having a predetermined secondary emission coefficient, said ducts each having an input portion in communication with the at least one electron source for receiving electrons and having a plurality of extraction locations for enabling the extraction of electrons from said duct;

c. an arrangement of distribution ducts disposed between the transport ducts and the luminescent screen, each distribution duct including at least first and second communicating passageways between one of the extraction locations and respective ones of the predefined areas of the screen;

d. extraction electrode means disposed adjacent the extraction locations for selectively effecting extraction of electrons from the transport ducts at selected ones of said locations;

e. selection electrode means disposed adjacent each of the first and second communicating passageways for effecting selective passage of electrons through said passageways.

11. A display device as in claim 10 where the extraction locations of adjacent ones of the transport ducts are arranged along parallel lines extending transversely to said transport ducts.

12. A display device as in claim 10 where the selection electrode means comprise an arrangement of line-sequentially-arranged sub-electrodes, where sub-electrodes associated with the first communicating passageways are electrically connected in parallel with each other, and where sub-electrodes associated with the second communicating passageways are electrically connected in parallel with each other.

13. A display device as in claim 10 where the arrangement of distribution ducts is separated from the face plate by spacer means.

14. A display device as in claim 13 where the spacer means comprises a system of mutually parallel walls extending transversely to the face plate.

15. A display device as in claim 13 where the spacer means comprises a plate having a plurality of apertures which are in alignment with respective ones of the first and second communicating passageways.

16. A display device as in claim 11 where:

a. the number of parallel lines corresponds to the number of lines of an image to be displayed;

b. the number of communication passageways in each distribution duct corresponds to the number of different colors to be displayed on the luminescent screen; and c. the luminescent screen comprises respective phosphor materials for producing said colors which are arranged in correspondence with said communication passageways.

17. A display device as in claim 11 where each extraction location includes first and second extraction apertures and where the extraction electrode means comprises a first system of sub-electrodes for selectively driving respective lines of the first extraction apertures and a second system of sub-electrodes for selectively driving respective lines of the second apertures.

18. A display device as in claim 10 where the arrangement of distribution ducts comprises a plurality of successive layers of distribution duct structures disposed between the transport ducts and the luminescent screen.

19. A display device as in claim 1 or 10 where the arrangement of distribution ducts comprises a plurality of successive distribution duct structures disposed between the transport ducts and the luminescent screen, each of said structures which is succeeded by another one of said structures having a multiplicity of electron output apertures, each being in communication with a respective plurality of electron input apertures of said succeeding structure.

20. A display device as in claim 19 where each of the distribution duct structures includes a multiplicity of electron carrying passages, each of said passages connecting an electron input aperture of said structure to a respective plurality of output apertures of said structure.

* * * * *